United States Patent [19]

Scholle et al.

[11] Patent Number: 5,000,359

[45] Date of Patent: Mar. 19, 1991

[54] SEALED SPIGOT

[75] Inventors: William R. Scholle, Corona Del Mar; Chester Savage, Irvine; Peter V. Schindler, Northridge, all of Calif.

[73] Assignee: Scholle Corporation, Irvine, Calif.

[21] Appl. No.: 405,456

[22] Filed: Sep. 11, 1989

Related U.S. Application Data

[63] Continuation-in-part of Ser. No. 335,040, Apr. 7, 1989, which is a continuation-in-part of Ser. No. 321,903, Mar. 10, 1989, abandoned.

[51] Int. Cl.[5] ..... B65D 47/10

[52] U.S. Cl. ..... 222/505; 222/517; 222/541; 215/232

[58] Field of Search ..... 222/541, 511, 505, 515–517, 222/528; 215/232

[56] References Cited

U.S. PATENT DOCUMENTS

| | | | |
|---|---|---|---|
| 3,120,908 | 2/1964 | Szajna et al. | 222/511 |
| 3,278,089 | 10/1966 | Heekin et al. | 222/189 |
| 3,400,866 | 9/1968 | Fattori | 222/511 |
| 3,443,728 | 5/1969 | Scholle | 222/511 |
| 3,493,146 | 2/1970 | Conners et al. | 222/153 |
| 3,595,445 | 7/1971 | Buford et al. | 222/511 |
| 3,696,969 | 10/1972 | De Van et al. | 222/105 |
| 3,772,715 | 11/1973 | Nigro | 222/547 |
| 3,972,452 | 8/1976 | Welsh | 222/501 |
| 4,169,548 | 10/1979 | Bond | 222/505 |
| 4,209,126 | 6/1980 | Elias | 215/232 |
| 4,211,348 | 7/1980 | Scholle | 222/498 |
| 4,248,362 | 2/1981 | Welsh et al. | 222/505 |
| 4,386,720 | 6/1983 | Speedie | 222/498 |
| 4,444,340 | 4/1984 | Bond et al. | 222/498 |
| 4,478,242 | 10/1984 | Bond | 137/383 |
| 4,527,703 | 7/1985 | Cummings | 215/232 |
| 4,579,260 | 4/1986 | Young et al. | 222/465 |
| 4,598,834 | 7/1986 | Singletary, Jr. | 215/232 |
| 4,623,077 | 11/1986 | Swartzbaugh | 222/517 |
| 4,645,100 | 2/1987 | Wells | 222/505 |
| 4,666,064 | 5/1987 | Hoehn | 222/105 |
| 4,706,855 | 11/1987 | Litwin | 222/511 |
| 4,711,380 | 12/1987 | Ulm | 222/541 |
| 4,722,458 | 2/1988 | Van Dal | 222/105 |
| 4,796,769 | 1/1989 | Obadia | 215/232 |
| 4,886,373 | 12/1989 | Corella | 383/104 |

FOREIGN PATENT DOCUMENTS

| | | | |
|---|---|---|---|
| 2705595 | 8/1978 | Fed. Rep. of Germany | 215/232 |
| 2307714 | 4/1975 | France . | |

*Primary Examiner*—Michael S. Huppert

*Attorney, Agent, or Firm*—Richard F. Carr; Richard L. Gausewitz; Allan Rothenberg

[57] ABSTRACT

A spigot for association with a spout connected to a container, the spigot including a cylindrical portion to fit over the end of the spout, a diaphragm for engaging the end of the spout to prevent flow of liquid, a toggle member for deflecting the diaphragm and an opening through the cylindrical portion for dispensing liquid upon the deflection of the diaphragm. The spigot includes a downspout extending from the opening and having a sealed outer end which is of a relatively thin-walled construction, the downspout having a thicker wall inwardly of the outer end to prevent collapse of the downspout during deflection of the diaphragm. The spigot member includes a relatively thin-walled portion inwardly of the thickened part of the downspout for facilitating deflection of the diaphragm. The spigot may be sealed by heat sealing together opposed wall portions of the downspout or by a tab heat sealed over the end of the downspout. The tab is a lamination of heat sealable and non stretchable materials, and may be integral with a cover which extends over and is heat sealed to the end of the spigot.

5 Claims, 4 Drawing Sheets

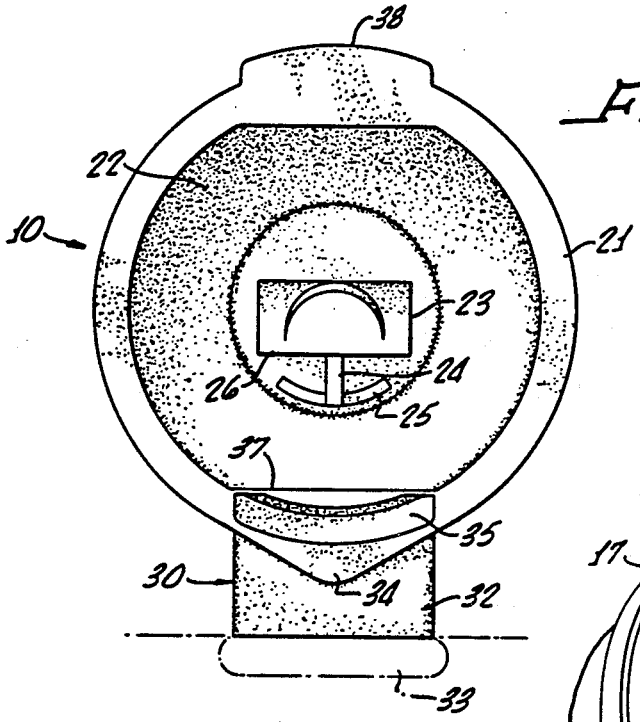
FIG. 4.
FIG. 5.
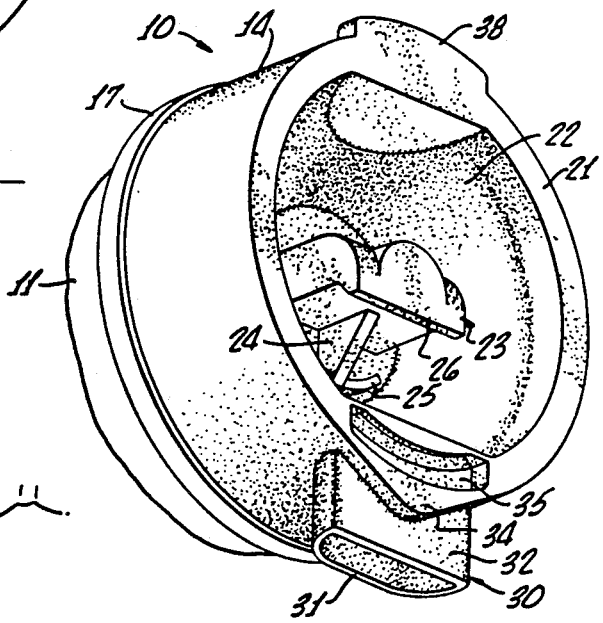
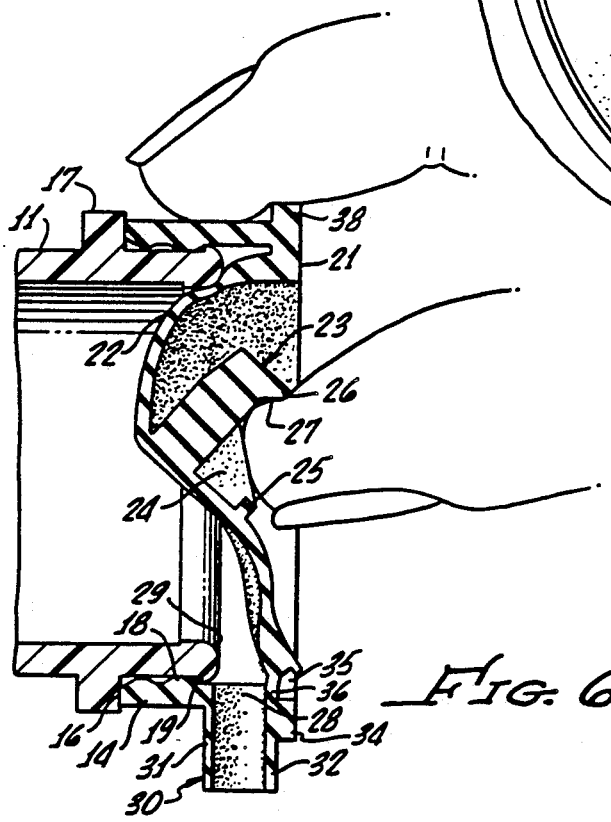
FIG. 6.

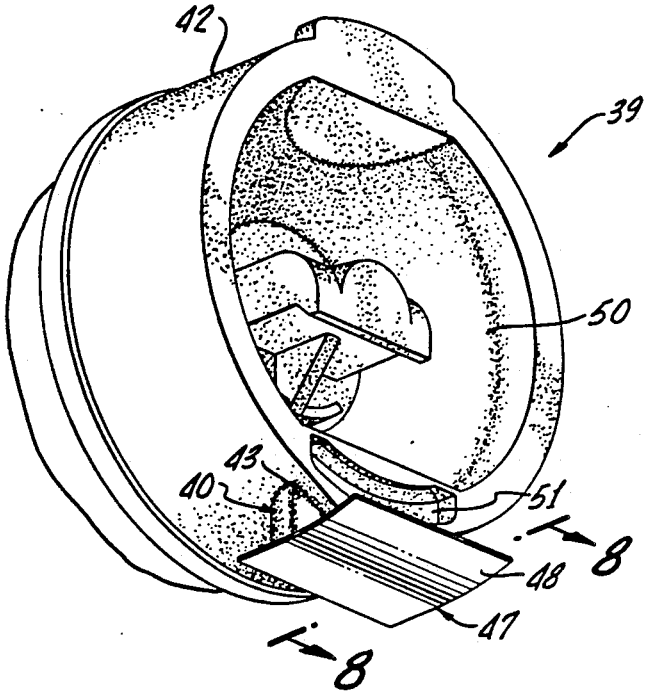
FIG. 7.
FIG. 8.
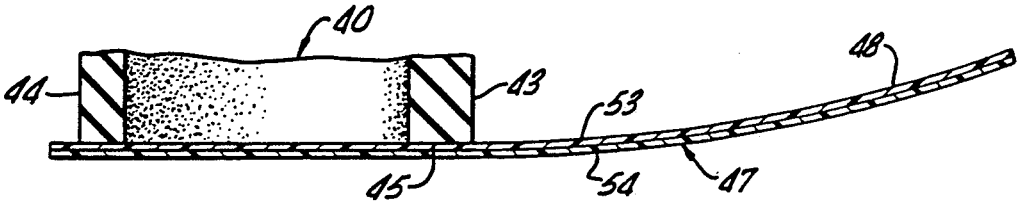
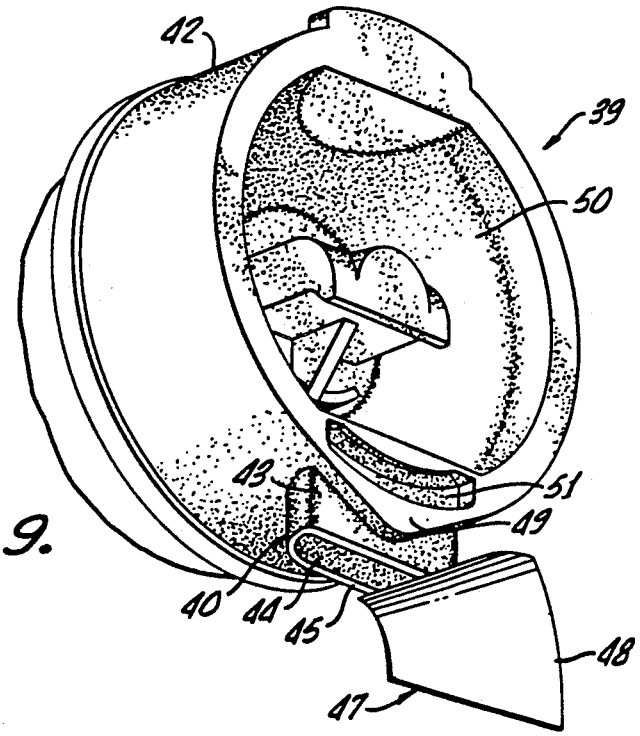
FIG. 9.

SEALED SPIGOT

CROSS-REFERENCE TO RELATED APPLICATIONS

The present application is a continuation-in-part of pending application Ser. No. 335,040, filed Apr. 7, 1989, for SEALED SPIGOT, which, in turn, is a continuation-in-part of application Ser. No. 321,903, filed Mar. 10, 1989, for SEALED SPIGOT now abandoned.

BACKGROUND OF THE INVENTION

This invention pertains to a spigot of the general type shown in W. R. Scholle U. S. Pat. No. 3,443,728. Spigots of this kind have gone into widespread use for containers for liquids such as water, wine, milk, and other fluids. These spigots include a cylindrical part that fits over the end of the spout of the container and a diaphragm of dome shape that extends from the outer end of the spigot and engages the outer end of the spout of the container for preventing flow through the end of the spout of the container. The cylindrical portion of the spigot includes an opening which can communicate with the contents of the container when the diaphragm is deflected. This will allow the dispensing of the contents of the container. Deflection of the diaphragm is accomplished by a toggle member which projects outwardly from the central portion of the diaphragm. Spigots of this type have been very successful as low cost items which nevertheless provide a positive flow control for the contents of a container and close to prevent dripping.

A need has existed, however, for an inexpensive tamper-proof arrangement which will assure that the contents of the container are sealed and are not contaminated. The conventional spigot, of course, can be opened at will so that the integrity of the contents cannot be assured. In the past, it has been necessary to provide a cap on the end of the spigot to assure complete sanitation. This, obviously, is expensive, requiring a separate item to place over the spigot and an additional manufacturing step.

There have been past proposals for an integral sealing arrangement that avoids the separate cap, but these have certain disadvantages. In one, disclosed in U.S. Pat. No. 4,711,380, a separate tear-away member is provided at the outlet of the spigot and is removed when the contents are to be dispensed. However, this member is integral with the remainder of the spigot and it is difficult to construct the unit so as to obtain a smooth tear while at the same time enabling the sealing member to be removed without undue difficulty. There is a tendency to obtain rough and irregular edges at the tear when the sealing member is removed. In another proposal, found in U.S Pat. No. 4,706,855, a modified spigot design has a downspout with a sealed outer end which is adapted to be torn or cut away. However, this construction requires pushing on the downspout to deflect the diaphragm and provide an outlet opening. The downspout becomes compressed from this operation, restricting the outlet opening, which is undesirable

SUMMARY OF THE INVENTION

The present invention provides a positively sealed spigot which requires no auxiliary sealing cap. Full flow is obtained when the spigot is opened so that the sealing arrangement does not penalize the ability of the spigot to dispense fluid. Opening of the seal is easily accomplished, when desired. The seal of this invention may be formed on a downspout which is integral with the remainder of the spigot and is economical to produce.

The device includes a downspout that extends away from the cylindrical portion of the spigot around the opening through that portion of the spigot. The outer end of the downspout is sealed.

There is a tendency of the downspout to become collapsed from the deflection of the diaphragm for dispensing fluid. This results from distortion of the outer wall of the downspout when the diaphragm is deflected. Collapse of the downspout is precluded, however, by a thickened portion that extends downwardly onto the upper portion of the outer wall of the downspout, making this portion of the downspout more rigid. The thickened part, in turn, will make it more difficult to deflect the diaphragm and open the spigot. This is taken care of, however, by a recess between the thickened part of the downspout and the inner wall of the diaphragm so as to provide a relatively thin-walled section of the end of the spigot member above the downspout and adjacent the diaphragm. As a result, the diaphragm is permitted to flex freely for dispensing the contents of the container.

In one embodiment, the tamper proof seal is formed by heat sealing together opposed portions of the outer end wall of the downspout. The downspout has a relatively thin wall at that location and so can be cut off with scissors to allow dispensing of liquid from the container with which the spigot is associated. Until the cutting of the downspout, the contents of the container are sealed and contamination cannot take place.

Cutting of the downspout is unnecessary in another arrangement where the downspout terminates in a flat end edge to which a removable tab is heat sealed. It is preferred to make this tab of a lamination, one layer of which is of a material which is readily heat sealed to the downspout and the other layer of which is of non-stretchable material. This allows an effective seal to be created, while at the same time enabling the tab to be removed in its entirety when the spigot is to be opened. The advantage of the downspout with its flat end edge is that the flat surface thus provided facilitates the heat sealing of the tab, as contrasted with heat sealing to a curved surface. The flat surface may be defined around an outlet opening by some portion of the spigot which does not constitute a downspout.

The tab may be a portion of an integral sheet of material which extends over the end face of the spigot and is heat sealed thereto, as well as being sealed to the end of the downspout. This protects the diaphragm and the toggle member which operates it keeping the entire end of the spigot sanitary and preventing movement of the toggle member so that the liquid of the container is not introduced into the downspout prior to the time when the contents are to be dispensed. Otherwise, if the valve has been opened at some earlier time, liquid will run out of the downspout unexpectedly when the tab is removed from the end of the downspout. The sheet of material over the end of the spigot may include an additional tab projecting upwardly which can be grasped for tearing the sheet away from the end of the spigot and from the end of the downspout.

The toggle member which operates the diaphragm includes a flange along its lower edge engageable by the thumb of the person operating the spigot. The outer periphery of the cylindrical portion is interrupted by a local radially extending flange at its upper end above the toggle member, where this can be engaged by the forefinger of the operator. The flange on the toggle member and on the cylindrical portion facilitate the actuation of the spigot and the deflection of the diaphragm.

BRIEF DESCRIPTION OF THE DRAWINGS

FIG. 4 is an end elevational view of the spigot;

FIG. 5 is a fragmentary perspective view of the spigot, similar to FIG. 2 but showing the downspout after it has been cut;

FIG. 6 is a transverse sectional view illustrating the actuation of the spigot to the open position for dispensing the contents of the container with which it is associated;

FIG. 7 is a perspective view of another embodiment of the spigot;

FIG. 8 is an enlarged fragmentary sectional view taken along line 8—8 of FIG. 7;

FIG. 9 is a perspective view of the spigot of FIG. 7, with the sealing tab partially removed;

DETAILED DESCRIPTION OF THE INVENTION

Figure 1:
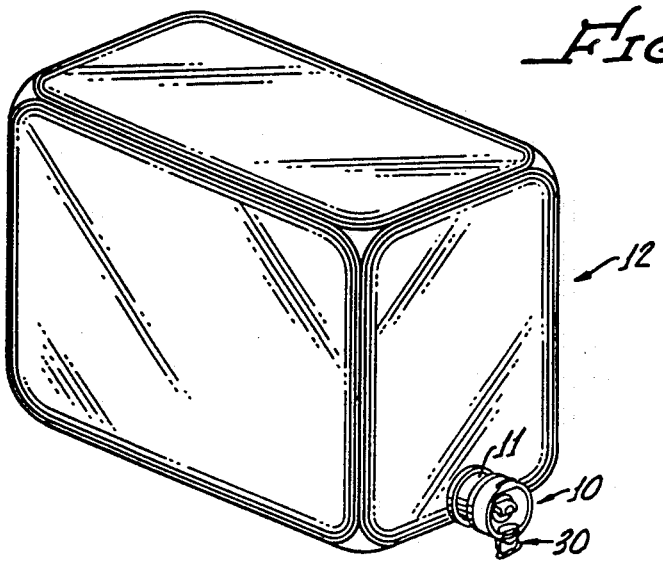
FIG. 1 is a perspective view of the spigot of this invention, as associated with a container.

The spigot 10 of this invention is for association with a conventional spout 11 of the type which is connected to or integral with a liquid container of any suitable type. The spout 11, for example, may be associated with a blow molded plastic bottle 12, used for water, such as illustrated in FIG. 1.

The spigot 10 is of the general type that fits over the end of the spout and includes a dome shaped diaphragm which acts as the closure. It is a one-piece member of elastomeric material, produced by molding. The spigot 10 includes a cylindrical tubular section 14 that fits over the outer end portion 15 of the spout 11, with the end 16 of the spigot butting against the outwardly projecting radial flange 17 of the spout. Inwardly of the end 16, the cylindrical portion 14 includes an internal bead 18 that fits next to an outwardly projecting radial shoulder 19 on the spout 11 beyond the flange 17. This holds the spigot 10 to the spout and prevents fluid leakage.

The annular outer end wall 21 of the spigot is radial relative to the cylindrical portion 14. At the outer end, a dome-shaped diaphragm 22 connects to the inner edge of the cylindrical portion and extends inwardly in the axial direction. At the center of the diaphragm 22 is an axially outwardly projecting lever or toggle 23 that is used in deflecting the diaphragm for opening the spigot, as discussed below. The toggle 23 is rectangular in cross-section and connects at its lower surface to an axially extending rib 24 that tapers downwardly and connects to a short curved ridge 25 that projects from the surface of the diaphragm 22.

The toggle 23 includes a transverse ridge 26 at its lower outer edge, the ridge having a radial outer face and a tapered inner face 27. This ridge, as explained below, facilitates the operation of the toggle.

Figure 2:
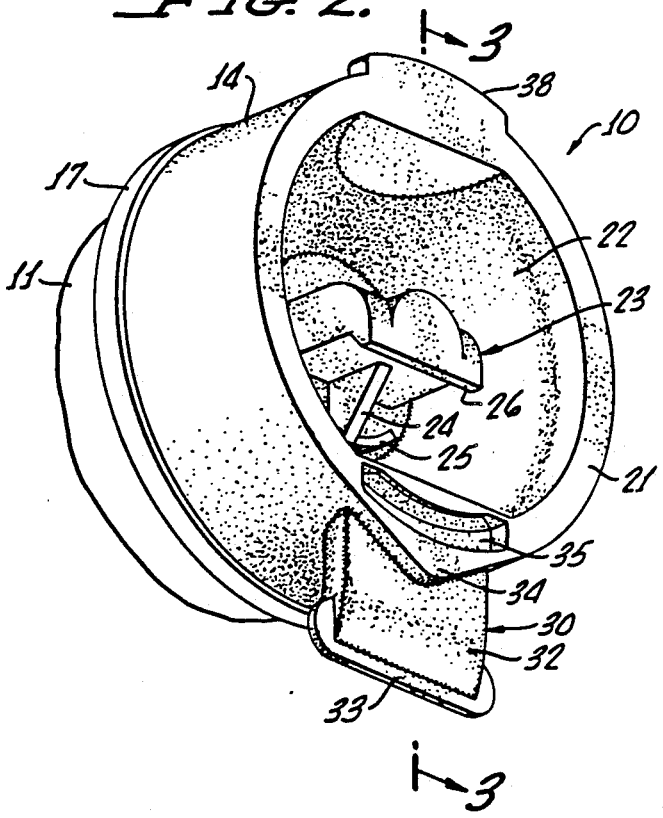
FIG. 2 is an enlarged fragmentary perspective view of the spigot, as viewed from below the outer end.
Figure 3:
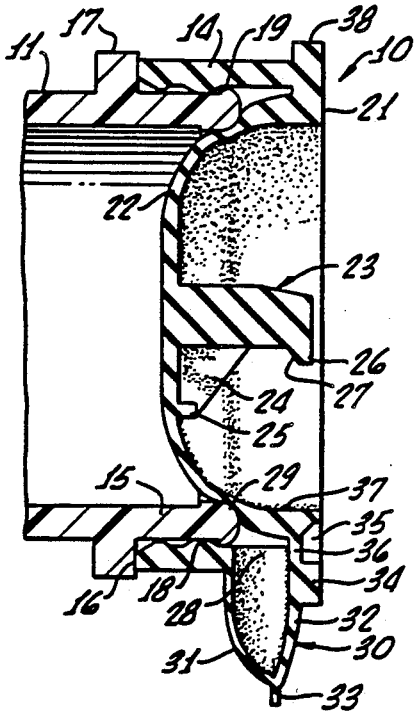
FIG. 3 is a transverse sectional view taken along line 3—3 of FIG. 2.

At the bottom of the cylindrical portion 14, adjacent the end wall 21, is an outlet opening 28 for dispensing the liquid from the container 12 to which the spout 11 is attached. When the spigot 10 is secured to the outer end of the spout 11, as shown in FIGS. 1–3, the diaphragm 22, in its free position, engages the curved outer end edge 29 of the spout 11, which prevents the liquid within the container from gaining access to the opening 28. The opening 28 is elongated in a direction transverse to the axis of the cylindrical portion 14.

Depending from the cylindrical portion 14, just inwardly of the end wall 21 and extending around the opening 28, is a tubular downspout 30. The downspout 30 is relatively wide so that it can encompass the outlet opening 28, and includes an inner wall 31 and an outer wall 32. These walls are relatively thin and heat sealed together so as to form a closure at the outer end 33. This seals the spigot 10, protecting the contents of the container from contamination from the outside. No separate sanitary seal is required.

The end wall 21 of the spigot 10 includes an extension 34, which may be generally V-shaped, which extends downwardly on the upper portion of the outer wall of the downspout 30. This provides a thicker wall and, hence, a reinforcement for the upper portion of the outer wall 32 of the downspout.

An arcuate recess 35 extends inwardly from the outer surface of the thickened wall 34 above the downspout 30. The length of the recess 35 is substantially equal to the width of the downspout 30. The result is a localized relatively thin wall 36 along the outer part of the opening 28 just above the downspout 30 and beneath the diaphragm 22. Above the recess 35 is a chordal surface 37 which results in a thickened section at the lower edge of the diaphragm 22.

As mentioned above, the contents of the container are kept uncontaminated by virtue of the sealed downspout 30. There is no communication between the inside of the container and the outside because the sealed downspout 30 closes the opening 28, irrespective of deflection of the diaphragm 22.

When it is desired to dispense the liquid from the container 12, the downspout 30 is simply cut above its sealed outer end 33. This is easily accomplished with scissors by virtue of the thin wall of the downspout 30 at its outer end portion. When this is done, liquid can be dispensed from the container in the usual manner by pressing upwardly on the toggle 23, as shown in FIG. 6. This deflects the lower part of the diaphragm 22 away from the end edge 29 of the spout 11 and opens the outlet opening 28. This deflection of the toggle is made easier by virtue of the ridge 26 on the lower edge of the toggle 23, which provides a gripping spot for the thumb of the user, as illustrated in FIG. 6. In addition, there is an outward radial flange 38 at the upper end of the spigot 10 which is conveniently gripped by the forefinger of the user to facilitate manipulation of the toggle 23.

An important feature of the spigot 10 is the combination of the thickened wall portion 34 at the upper end of the downspout 30, together with the recess 35 to provide a thin-walled portion 36 aboVe the portion 34. The thicker wall at the portion 34 provides added strength that prevents the outer wall of the downspout from collapsing when the toggle is moved for dispensing the liquid. If the downspout 30 is made with a continuous thin wall, there is a tendency for the movement of the diaphragm 22, when the toggle 23 is actuated, to produce a reaction which will cause the outer wall of the downspout to collapse inwardly. When that occurs, the flow through the outlet is reduced to an unsatisfactory level. Despite the rigidity resulting from the thickened portion 34, the thin-walled part 36, resulting from the recess 35 above the thickened portion 34, facilitates the moving of the diaphragm 22 to the opened position when the toggle 23 is pushed upwardly. In the absence of the thin-walled portion 36, there is excessive thickness in the forward end portion of the spigot 10 below the diaphragm 22, which resists the deflection necessary for pivoting the diaphragm to the opened position. This will make it difficult to open the spigot. However, with the inclusion of the slot 35 and the thin-walled portion 36, there is no interference with the movement of the diaphragm to the opened position and the valve of the spigot 10 works freely.

The embodiment of FIGS. 7, 8 and 9 provides a sealed tamper-proof spigot for which it is unnecessary to cut off the end of the downspout when the contents of the container are to be dispensed. Instead, a tear-away tab is heat sealed to the end of the downspout, initially protecting the contents of the container and then removable so that the spigot can be opened.

The spigot 39 shown in FIGS. 7, 8 and 9 is identical to the spigot 10 of FIGS. 1 through 6, except for the outer end of the downspout 40. The latter element communicates with an opening through the cylindrical portion 42 of the spigot 39 in a manner similar to the arrangement of the downspout 30 with respect to the opening 28 of the spigot 10. The downspout 40 is elongated in a direction transverse to the longitudinal axis of the spigot and includes relatively thin outer and inner walls 43 and 44, respectively.

At its outer end, the downspout 40 is provided with a flat transverse end edge surface 45. A thin strip of flexible material 47 forms a tab which is heat sealed to the end edge surface 45 of the downspout 40, thereby closing off the end of the downspout and preventing communication between the interior and exterior of the container to which the spigot 39 is attached. The tab 47 is made wider than the space between the forward and rearward walls 43 and 44 of the downspout 40 so that a substantial edge portion 48 projects outwardly beyond the outer wall 43. This part of the tab 47 is conveniently grasped by the fingers of the user and torn away from the end edge 45, thereby opening the end of the downspout. This, of course, permits the dispensing of materials from within the container to which the spigot 39 is attached. When the tab 47 is in position on the downspout, however, there is a visual indication that a perfect seal exists, preventing contamination or discharge of the contents of the container to which the spigot is attached.

When the tab 47 is torn away from the end edge 45, the spigot 39 functions exactly as does the spigot 10 after the cutting of the downspout 30. The thickened part 49 at the inner end of the downspout provides rigidity which prevents collapse of the outer wall 43 as the diaphragm 50 is deflected for opening the spigot. The thin-walled part 51 above the thickened portion 49 allows the diaphragm 50 to be deflected without difficulty.

As illustrated in FIG. 8, it is preferred to make the tab 47 from laminated material in order to achieve the characteristic necessary for proper functioning of the tab. One layer 53 is made of a material which is readily heat sealed. This layer is positioned adjacent the end edge 45 so that the heat sealed attachment is made to the layer 53. The other layer 54, which is laminated to the layer 53, is of a material which is essentially nonstretchable. This permits the tab 47 to be torn away from the end edge 45 without difficulty because the tab will not yield as the force is applied to it. Polyethylene is suitable for the material 53 that is heat sealed to the end edge 45 of the downspout 40. The other nonstretchable layer 54 may be polyester resin.

Figure 10:
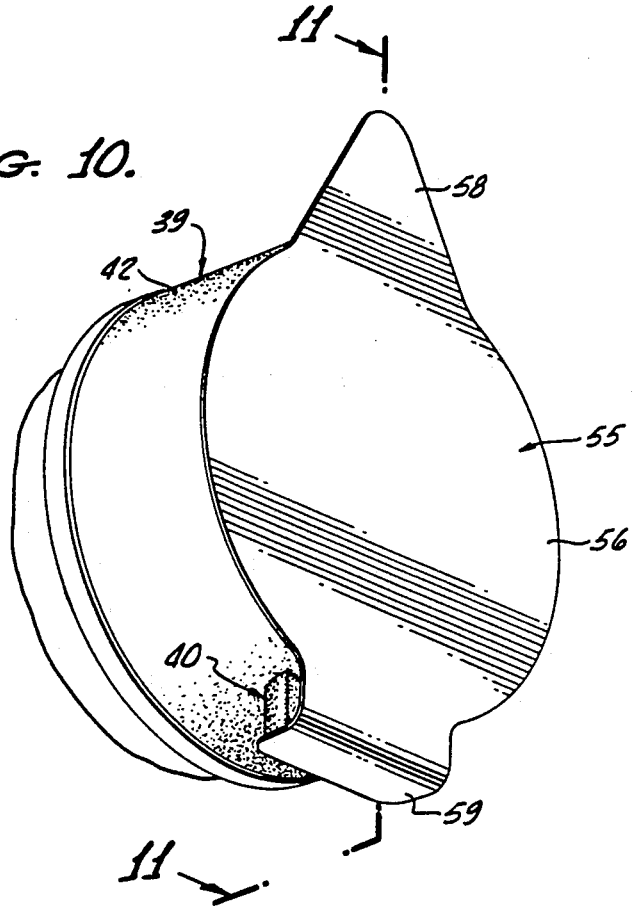
FIG. 10 is a perspective view of a spigot with a cover over the spigot end and the downspout.

In the embodiment of FIGS. 9 and 10, a sheet of flexible material 55 covers not only the end of the downspout 40, but also extends across the forward radial face of the spigot. The material for the sheet 55 may be the same as that for the tab 47, being laminated of two materials, one of which is readily heat sealable and the other of which has resistance to stretching. As before, the heat sealable layer is positioned adjacent the fitment.

The sheet of material 55 includes a generally circular portion 56 that is heat sealed to the flat forward end surface 57 of the tubular portion 42 of the spigot 39. A tab 58 projects away from the upper end of the portion 56 and is readily grasped for tearing the strip 55 away from the spigot 39. An additional tab 59 projects from the lower end of the sheet 55 and is bent inwardly to extend across the lower end edge surface 45 of the downspout 40. The tab 59 is heat sealed to the edge surface 45. Hence, when the sheet 55 is pulled away from the spigot 39 it also is removed from the edge 45 of the downspout 40 so that the downspout may be opened.

Figure 11:
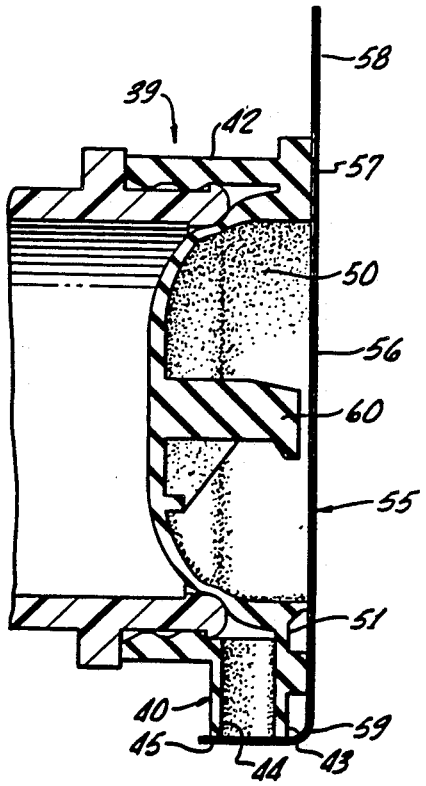
FIG. 11 is a sectional view taken along line 11—11 of FIG. 10.

The embodiment of FIGS. 10 and 11 has the advantage of providing a sanitary cover for the entire exposed end of the spigot 39. Moreover, with the lever or toggle 60 of the spigot covered, it is not subject to being moved and displaced while the container to which the spigot is attached is on the shelf. Therefore, the diaphragm 50 will not be moved to the open position and no liquid will be dispensed down into the area of the downspout 40 prematurely. When the tab 59 is removed, no liquid will run out until the toggle 60 subsequently is actuated.

The foregoing detailed description is to be clearly understood as given by way of illustration and example only, the spirit and scope of this invention being limited solely by the appended claims.

What is claimed is:

1. A sealed spigot comprising an integral member having a tubular portion having one end adapted to fit over a spout, a diaphragm extending inwardly from said tubular portion adjacent the opposite end of said tubular portion, said diaphragm being adapted to engage the end of a spout for forming a seal therewith, said diaphragm including means thereon for permitting deflection of a portion of said diaphragm away from the end of such a spout, said tubular portion having an opening adjacent said portion of said diaphragm for providing an outlet when said diaphragm is so deflected, and a downspout extending from said tubular portion at said opening, said downspout having a substantially flat outer end surface, a sheet of material having a first portion extending over and heat sealed to said opposite end of said tubular portion and a second portion extending over and heat sealed to said outer end surface of said downspout for covering said diaphragm and said means for permitting deflection of a portion of said diaphragm, and for closing and sealing said downspout and preventing communicating between the exterior of said spigot and said opening, said sheet of material being tearable away from said opposite end of said tubular portion and from said end surface of said downspout for opening said downspout, said downspout adjacent said outer end thereof having a first wall portion, said downspout inwardly of said outer end thereof having a second wall portion, said second wall portion being thicker than said first wall portion for preventing collapse of said downspout upon such deflection of said diaphragm, said member including a third wall portion between said second wall portion of said downspout and said diaphragm, said third wall portion being thinner than said second wall portion for facilitating said deflection of said diaphragm.

2. A device as recited in claim 1 in which said sheet of material comprises a lamination, a first layer of which is of a material which can be heat sealed and a second layer of which is of a substantially nonstretchable material, said first layer being so heat sealed to said opposite end of said tubular portion and to said outer end surface of said downspout.

3. A sealed spigot comprising an integral member having a tubular portion having one end adapted to be connected to a spout, a diaphragm extending inwardly relative to said tubular portion adjacent the opposite end of said tubular portion, said diaphragm being adapted to engage the end of a spout for forming a seal therewith, said diaphragm including means thereon for permitting deflecting of a portion of said diaphragm away from the end of such a spout, said tubular portion having means defining an opening, adjacent said portion of said diaphragm for providing an outlet when said diaphragm is so deflected, said means defining an opening including a downspout projecting from said tubular portion and having a substantially flat end surface at the outer end thereof, tab means extending over said substantially flat end surface for sealing the same and preventing communication between the interior of said tubular portion and the exterior of said spigot, said tab means being a lamination including a first layer of a material which is adapted to be heat sealed and a second layer of a material which is relatively nonstretchable, said first layer being adjacent and heat sealed to said substantially flat end surface for so sealing the same, said tab means being tearable away from said substantially flat end surface without significant distortion of said tab means as a result of said material of said second layer which is relatively nonstretchable.

4. A sealed spigot comprising an integral member having a tubular portion having one end adapted to be connected to a spout, a diaphragm extending inwardly relative to said tubular portion adjacent the opposite end of said tubular portion, said diaphragm being adapted to engage the end of a spout for forming a seal therewith, said diaphragm including means thereon for permitting deflection of a portion of said diaphragm away from the end of such a spout, said tubular portion having means defining an opening adjacent said portion of said diaphragm for providing an outlet when said diaphragm is so deflected, tab means extending over said means defining an opening for sealing the same and preventing communication between the interior of said tubular portion and the exterior of said spigot, said tab means being a lamination including a first layer of a material which is adapted to be heat sealed and a second layer of a material which is relatively nonstretchable, said first layer being adjacent and heat sealed to said means defining an opening for so sealing the same, said tab means being tearable away from said means defining an opening without significant distortion of said tab means as a result of said material of said second layer which is relatively nonstretchable, and a sheet of material integral with said tab means extending over said opposite end of said tubular portion and being heat sealed thereto for thereby covering said diaphragm and said means for permitting deflection of a portion of said diaphragm, said sheet of material being tearable away from said opposite end of said tubular portion for permitting access to said means for permitting deflection of a portion of said diaphragm.

5. A device as recited in claim 4 including a second tab means extending outwardly from and integral with said sheet of material for providing a means which can be grasped for tearing said sheet of material away from said opposite end of said tubular portion and said first mentioned tab means away from said means defining an opening.

* * * * *